US006857380B1

(12) United States Patent
Robinson

(10) Patent No.: US 6,857,380 B1
(45) Date of Patent: Feb. 22, 2005

(54) SAILBOAT SPINNAKER BOWSPRIT

(76) Inventor: Brad Robinson, 20614 Linwood Rd., Excelsior, MN (US) 55331

( * ) Notice: Subject to any disclaimer, the term of this patent is extended or adjusted under 35 U.S.C. 154(b) by 0 days.

(21) Appl. No.: 10/717,789

(22) Filed: Nov. 20, 2003

(51) Int. Cl.[7] ..... B63B 15/00
(52) U.S. Cl. ..... 114/98
(58) Field of Search ..... 114/102.28, 102.3, 114/97, 98, 99, 89

(56) References Cited

U.S. PATENT DOCUMENTS

| | | | | |
|---|---|---|---|---|
| 3,830,010 A | * | 8/1974 | Lindsey | 446/77 |
| 3,841,251 A | | 10/1974 | Larson | |
| 3,968,763 A | | 7/1976 | Mason | |
| 4,354,447 A | * | 10/1982 | Hultgren | 114/255 |
| 5,176,401 A | * | 1/1993 | Chapman | 280/775 |
| 5,765,498 A | | 6/1998 | Hammarstedt | |
| 6,189,471 B1 | * | 2/2001 | Mitchell et al. | 114/39.21 |
| 6,250,242 B1 | | 6/2001 | Modes | |

OTHER PUBLICATIONS

"Antrim 27 Designer's Comments", http://www.antrim-design.com/a27index.html, internet publication date established by http://www.archive.org/ as at least as early as Oct. 12, 2002.*

Sven Donaldson, "Open Season", from Sail, Jun. 2002, pp. 69–74.

Garry Hoyt, "In Full Swing", from Sail, Tech Notes, Feb. 2004.

* cited by examiner

*Primary Examiner*—Andrew Wright
(74) *Attorney, Agent, or Firm*—Nawrocki, Rooney & Sivertson, P.A.

(57) ABSTRACT

A retractable bowsprit for a sailboat is suitable for use with an asymmetrical spinnaker. A support element and a bowsprit positioner such as a track mounted within a hull of a sailboat allow the bowsprit to assume either an extended or retracted position. The bowsprit positioner is mounted to the bottom of the hull. The support element is positioned forward of and above a forward position of the positioner. The bowsprit can slide through the support element, to allow an aft end of the bowsprit to be attached to the positioner's forward point in the extended position. When the bowsprit is so positioned, the geometry causes the bowsprit to rotate, placing a forward end thereof substantially further above the waterline than is the deck, allowing the crew a view beneath an asymmetrical spinnaker attached to the bowsprit forward end.

20 Claims, 3 Drawing Sheets

SAILBOAT SPINNAKER BOWSPRIT

BACKGROUND OF THE INVENTION

The terminology used in the description that follows is that standard for (and often unique as well to) sailing and yachting. A few sailing terms will be defined initially. Other sailing terms will be explained as they arise.

Hull—the entire floating structure of a sailboat.

Bottom—the portion of a sailboat that is immersed or partly immersed in the water and that provides the buoyancy supporting the entire sailboat.

Deck—a portion of a sailboat hull whose surface is generally horizontal, and on or in which the crew may stand, walk, or sit, and that is not part of the bottom.

Spar—a relatively rigid elongate pole that supports a sail in some way. Booms, masts, and sprits are types of spars.

Bow—the front portion of a boat hull.

Stern—the rear portion of a boat hull.

Line—a control rope on a sailboat. Sheets for controlling sail trim and halyards for raising sails are two types of lines.

Fore—towards the bow of a boat.

Aft—towards the stern of a boat.

Port—the left side of a boat.

Starboard—the right side of a boat.

Port tack—when the main boom of a sailboat is on the starboard side of a sailboat hull centerline.

Starboard tack—when the main boom of a sailboat is on the port side of a sailboat hull centerline.

Leeward side—the side of the boat on which the main boom is being carried at any given time.

Windward side—opposite of leeward side.

Beating, on a beat—sailing as close to the wind as is possible. (Sailboats typically have the ability to sail within 50 ° or less of the true wind. This ability is the reason that sailboats can sail a zigzag route to a point directly upwind from a starting point.)

Hundreds of different sailboat designs exist, from hulls as small as 8 feet or less to well over 100 feet long. Most sailboats have V bows enabling them to slice through waves and chop efficiently. Such boats can be designed with relatively high freeboard (distance from the deck edge to the water) allowing the hull interior to remain relatively dry when higher waves are present. Other types have relatively low freeboard and typically are designed to rely on crew weight to oppose the wind force on sails.

Nearly every modern sailboat has a mainsail, the triangular sail extending behind the mast. The mast is a spar extending vertically from the deck. Sloop-rigged sailboats (sloops) also have a triangular jib sail also supported by the mast at the head, or topmost corner of the triangle. Some sloops have a bowsprit extending forward from the bow to which a jib is attached.

Many sailboats also are rigged to carry spinnakers, large sails used for running (sailing downwind) and reaching. Reaching refers to sailing at angles to the true wind between beating and running, or approximately from 50° to 160° from the true wind.

Spinnakers have typically had an isosceles triangle shape. A spinnaker is stowed when a sailboat is beating, and then lifted with a spinnaker halyard to place the head near the top of the mast when reaching and running. Spinnakers have one of the lower corners attached to a forward end of a spinnaker pole. Conventionally, the aft or rearmost end of the spinnaker pole has been attached to the front of the mast. When the spinnaker is stowed, the spinnaker pole is removed from the mast and stowed as well.

The invention pertains to spinnakers. A newer design of spinnaker pole is really not a spinnaker pole at all, but more accurately is termed a bowsprit. Such a bowsprit is permanently mounted in the bow of the sailboat. These usually can be retracted along an approximately horizontal path into the hull when the sailboat is not carrying the spinnaker so that the bowsprit will not be damaged by other sailboats crossing the bow.

A spinnaker carried on a retractable bowsprit is typically asymmetrical, i.e., the triangular sail shape is scalene rather than the generally isosceles shape of conventional spinnakers. The longest edge of an asymmetrical spinnaker is typically connected between the forward end of the bowsprit and the mast. The other vertical edge of an asymmetrical spinnaker is trimmed with a spinnaker sheet to a leeward point on the boat hull similar to that for a conventional spinnaker.

The advantage of an asymmetrical spinnaker is to allow faster reaching speeds than is possible with a symmetrical spinnaker. Some sailboats can sail more rapidly to a particular downwind point by reaching for a time, and then jibing to a reach on the opposite tack, rather than by running directly downwind. ("Jibing" refers to steering the sailboat stern through the wind from one tack to the other while sailing downwind.)

Since sailboats usually reach on downwind courses when asymmetrical spinnakers are hoisted, the paths of sailboats competing in a race tend to cross on downwind courses. Rules under which sailboat races are conducted impose obligations on sailboats to avoid contact (read: collisions) with other sailboats. These rules apply such that in every situation, as between any two sailboats whose courses are converging, one must alter course to prevent contact with the other.

A scow is a type of sailboat that has a flat bottom, a relatively shallow hull, and a rounded, blunt bow rather than a V hull. Scows are usually sailed with significant heel. This lengthens the immersed water line substantially, increasing the speed potential of the sailboat. At the same time, the broad, flat bottom provides excellent stability when the sailboat is moored. Scows rely on crew weight to oppose the wind force tending to tip the boat. Asymmetrical spinnakers are now class legal on the largest scow now sailing, the 38 ft. A scow.

In the current A scow design, the bowsprit extends linearly through a fixed internal brace member and a deck fitting near the front of the deck. Because of the relatively shallow scow hull, the tip of the extended bowsprit is only a little above the deck level and close to the water.

For these reasons, asymmetrical spinnakers flown by scows tend to sweep the front deck, interfering with vision behind the spinnakers. The heeling of a scow only increases the vision problem. This leads to risky situations, with the crew's view of sailboats on converging courses obscured. In fact, the problem to some extent affects sailboats other than scows when flying asymmetrical spinnakers. This problem does not normally exist with symmetrical spinnakers since the mast-mounted spinnaker poles used with them supports the foot of the spinnaker a good distance above the deck.

One possible solution to this vision problem is to place a clear, flexible plastic window in the foot of the spinnaker. Unfortunately, it is not easy to put windows in spinnakers.

Spinnakers are made of relatively light material. The clear plastic material from which windows are made is substantially heavier and stiffer that spinnaker material, leading to poor spinnaker shape and slower sailing.

Accordingly, another solution to the problem of poor visibility with asymmetrical spinnakers is necessary.

BRIEF DESCRIPTION OF THE INVENTION

I have discovered a solution to the problem of poor visibility when sailing a sailboat flying an asymmetrical or other spinnaker from a bowsprit. My solution is particularly suitable for sailboats with relatively shallow hulls such as scows. The sailboat has a hull comprising a deck and bottom joined to form a bow.

My solution is a novel bowsprit extending system for the bow of a sailboat hull that places an elongate bowsprit having a forward end and an aft end in either a retracted position with the bowsprit forward end near the forward end of the sailboat, or in an extended position with the bowsprit forward end forward of and substantially above the sailboat bow.

A bowsprit positioner has a forward position and an aft position and is mounted generally fore and aft on the sailboat bottom in the bow somewhat aft the front of the bow. The aft end of the bowsprit is positionable at either the forward or aft location of the positioner.

A bowsprit support element is mounted on the hull above and forward of the positioner forward position, typically at the forward end of the deck. The support element is operatively, typically slidingly, attached to the bowsprit between the bowsprit's ends.

When the aft end of the bowsprit is positioned at the positioner aft location, the bowsprit is in the retracted position within the hull with the bowsprit forward end near to the bow. Positioning the aft end of the bowsprit at the positioner forward location projects the bowsprit forward end forward of the hull and substantially further above the water than is the deck.

The positioner forward and aft locations are such that during the transition between the retracted and extended positions, the bowsprit rotates through perhaps 20° to 30° or more about a horizontal axis transverse to the sailboat centerline. This rotation places the forward tip of a bowsprit deployed in this way, far above the waterline and deck level. The foot of a spinnaker attached to a bowsprit deployed in this way is thus far above the deck, allowing for clear vision from the cockpit to leeward of the spinnaker. At the same time, spinnaker performance does not appear to be impaired in the slightest.

In a preferred embodiment the positioner comprises a traveler track extending between the forward and aft locations. A car slides on the track between the forward and aft locations. The aft end of the bowsprit is connected to the car. A car control mechanism positions the car at either the forward or aft location to thereby place the bowsprit in either the extended or retracted position.

In another version, I have devised apparatus that can support a bowsprit at an angle of more than 30° above the surface of the water with only internal hull bracing of the bowsprit to support the bowsprit with adequate strength for carrying a large spinnaker.

DESCRIPTION OF THE PREFERRED EMBODIMENTS

Figure 1:
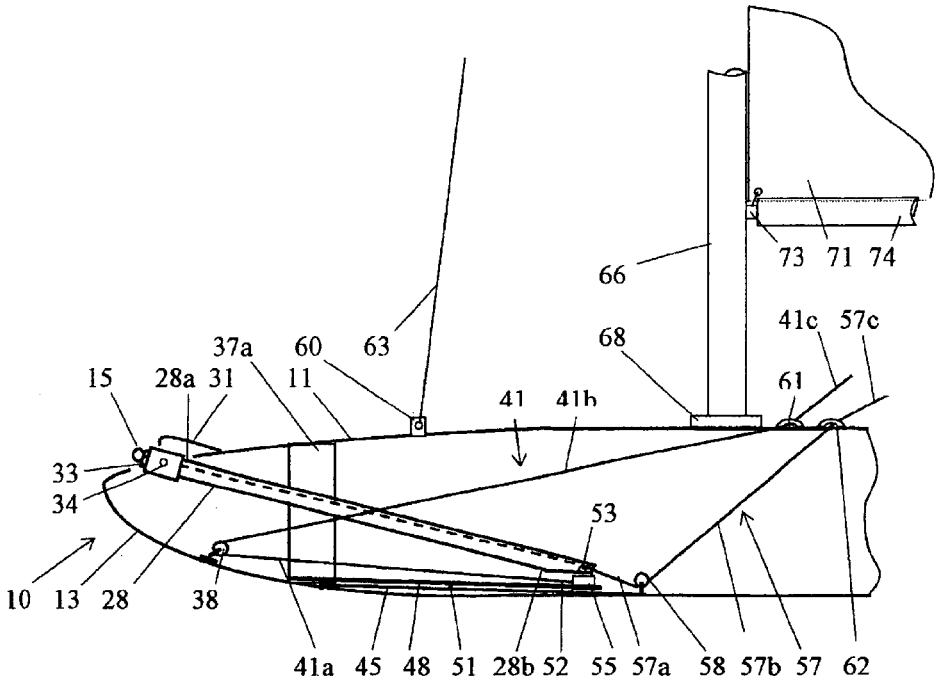
FIG. 1 is an open side view of a sailboat hull incorporating the invention, and with a bowsprit in a retracted position.
Figure 2:
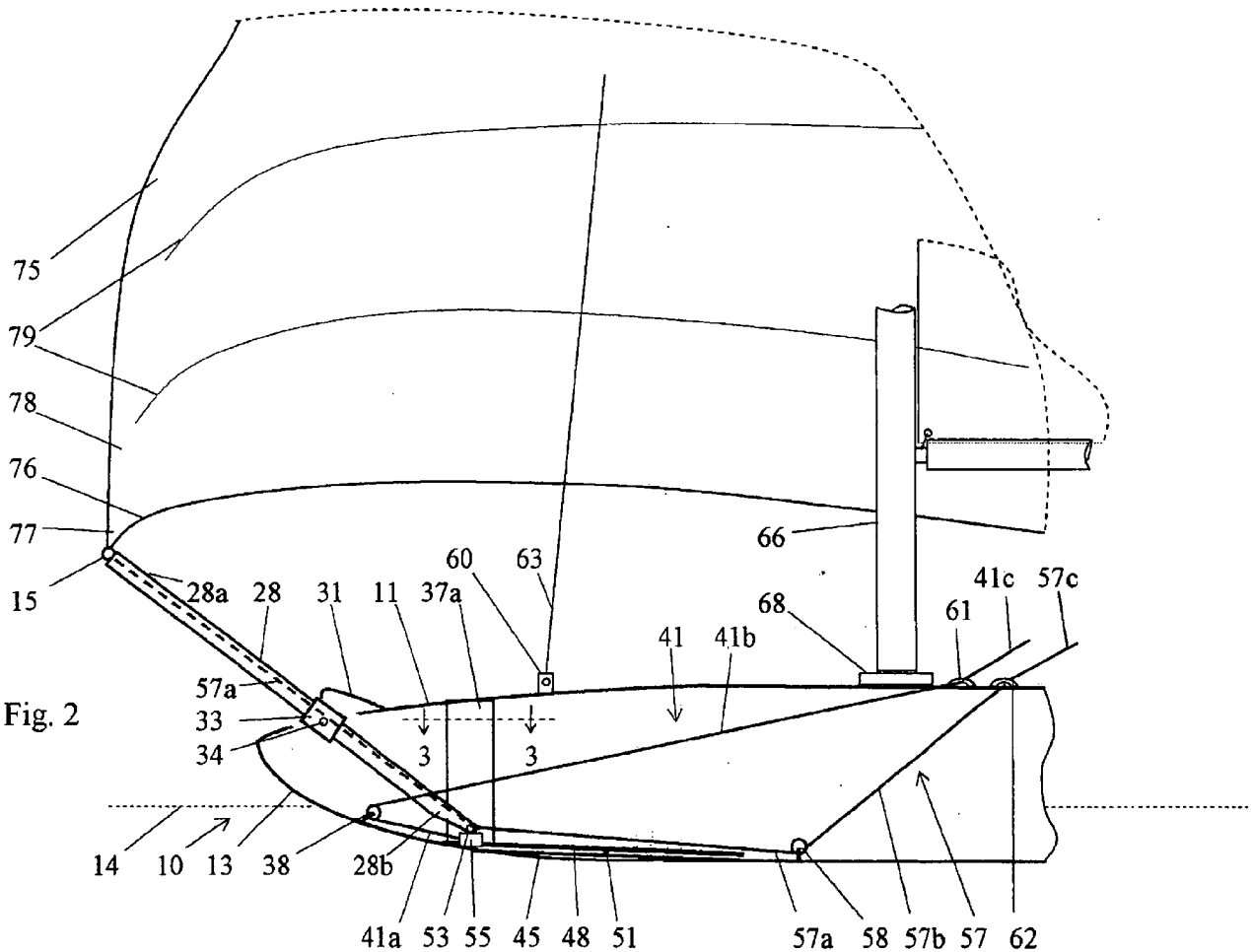
FIG. 2 is an open side view of the sailboat incorporating the invention, and with the bowsprit in an extended position.

FIGS. 1 and 2 are port side views of the interior of a sailboat hull 10 incorporating the invention. The port side is shown open in each to reveal the features of the invention.

The hull 10 conventionally comprises a deck 11 and a bottom 13. A conventional mast 66 is supported on a mast step 68. A forestay 63 is attached between a mast hound located on mast 66 above the structure shown in FIG. 1 and a chainplate 60 on the surface of deck 11. Sidestays, not shown, cooperate with forestay 63 to support mast 66 in a vertical position.

A boom 74 is attached to mast 66 by a gooseneck 73. A cockpit (not shown) is formed in hull 10 aft of mast 66. A mainsail 71 is carried on boom 74 and mast 66. Sail control equipment is of course needed, but is not shown, as having no particular relationship to the invention. A cockpit is provided in hull 10 generally aft of mast 66 and under boom 74.

To provide an idea of the scale of these elements, a 38 ft. A scow has a mast 66 that is 40 ft. long and a boom 74 that is 20 ft. long. The total area of the mainsail 71 and a jib sail (not shown) is about 550 sq. ft.

A bowsprit 28 is shown in FIG. 1 in a retracted position within hull 10. Bowsprit 28 has a forward end 28*a* and an aft end 28*b*. A spinnaker attachment fitting 15 is mounted on the bowsprit forward end 28*a*. Preferably, fitting 15 is attached to a tack line 57.

In my preferred embodiment I have a bowsprit positioner including an extender track 48 and an extender car 55. Track 48 is mounted to the upper surface of bottom 13 within hull 10 and extends between a generally forward position shown in FIG. 2 and an aft position generally aft of the forward position and shown in FIG. 1. Screws 51 attach track 48 to a reinforcing pad 45 integral with the upper surface of bottom 13. Car 55 slides on track 48 between the aft position of FIG. 1 and the forward position of FIG. 2.

Harken, at 1251 E. Wisconsin Ave., Pewaukee, Wis. 53072 manufactures and sells a number of different traveler systems intended to form a part of the sheeting system for mainsails such as mainsail 71. These traveler systems include a track and a car incorporating ball or roller bearings. Such a traveler system can be used as track 48 and car 55, and allows easy movement of car 55 on a track 48 even when under substantial load. For an A scow, a 7 ft. Harken Model 2720 track with a Model 158 car provides adequate length of car 55 movement and sufficient strength for the mechanical loads involved.

Bowsprit 28 is attached to car 55 by a bowsprit connector such as a pivot pin 53. Pivot pin 53 has a generally horizontal and transverse axis and allows bowsprit 28 to rotate through an articulation angle of 20° or more. A typical traveler car 55 has a strong shackle mounted in its body. Pivot pin 53 may comprise a bolt secured by a lock nut passing through holes at bowsprit aft end 28*b* and the traveler car 55 shackle.

FIG. 2 shows the sailboat of FIG. 1 on port tack with bowsprit 28 in the extended position. The forward, lower portion of a spinnaker sail 75 is shown, with the tack 77 of spinnaker 75 attached to attachment fitting 15 on bowsprit 28. The spinnaker 75 extends upward above the structure displayed in FIG. 2, to a mast hound fitting that is used to lift and support spinnaker 75. A clew of spinnaker 75 at the lower, aft corner of spinnaker 75 is not shown but is attached to a spinnaker sheet to control the setting angle and draft (curvature) of spinnaker 75. Draft lines 79 are intended to show the curvature of spinnaker 75, which in FIG. 2 is concave facing the viewer.

When extending and retracting, bowsprit 28 slides along a portion of its length through a bore of a sleeve 33. Sleeve 33 is mounted on a pivot 34 fixed in deck 11 and is within a cowling 31 at a point of deck 11 slightly aft of the front of the bow. Pivot 34 rotates on an axis that is transversely oriented to the bowsprit 28 and hull 10 centerline and substantially parallel to the unheeled hull 10 waterline. Pivot 34 positions sleeve 33 vertically forward of and above the forward position of track 48. Sleeve 33 and pivot 34 together form a support element for bowsprit 28.

Tack line 57 forms one part of a bowsprit 28 position control mechanism. Line 57 can be divided into tack line segments 57*a*, 57*b*, and 57*c*. Segment 57*a* extends from attachment fitting 15 internally the length of bowsprit 28, and further aft to a block 58 mounted on bottom 13. Tack line 57 is turned through block 58 to form the second line segment 57*b* extending to a deck-mounted cleat 62. Tack line 57 extends through cleat 62 to form the third line segment 57*c*.

A crew member pulls line segment 57*c* as needed to position attachment fitting 15 at the end of bowsprit 28 and to cause car 55 to travel on track 48 from the forward position shown in FIG. 2 toward the aft position of FIG. 1 to thereby retract bowsprit 28. Releasing line 57 from cleat 62 allows a crew member to pull attachment fitting 15 aft to the cockpit when attaching or detaching spinnaker 75, and to allow bowsprit 28 to extend to the position of FIG. 2.

An extender line 41 forms another part of the bowsprit position control mechanism. Extender line 41 is divided into segments 41*a*, 41*b*, and 41*c*. Line segment 41*a* is attached at one end to car 55 and extends to turn through a block 38 attached forward of track 48 to the upper surface of bottom 13. Line segment 41*b* extends aft from block 38 to a cleat 61 attached to the deck 11 near the cockpit. Segment 41*c* is also available for use by a crew member in the cockpit.

Pulling on segment 41*c* causes car 55 to travel on track 48 forward toward the forward position on track 48 shown in FIG. 2, extending pole 28. Releasing line segment 41*c* from cleat 61 allows a crew member to pull tack line 57 thereby shifting car 55 toward the aft end of track 48. For a larger spinnaker such as on an A scow, a tackle arrangement for line 41 is needed to oppose the substantial spinnaker 75 forces imposed on attachment fitting 15. Line segments 41*c* and 57*c* together comprise a control element for controlling the position of bowsprit 28.

As bowsprit 28 slides through sleeve 33, both rotate through an articulation angle with respect to hull 10 that should normally be 20° or more. Bowsprit 28*b* of course rotates on pivot pin 53 through a similar angle. This rotation lifts the forward end 28*a* a substantial distance above the water. The articulation angle for bowsprit 28 may exceed 25 or even 30°.

One can see that forward end 28*a* of bowsprit 28 when extended as shown in FIG. 2 is substantially higher above a typical waterline 14 than would be the case if bowsprit 28 were to be extended from the bow of hull 10 parallel to the angle for bowsprit 28 shown in FIG. 1. This higher position of forward end 28*a* holds the foot of spinnaker 75 substantially further above waterline 14 than is deck 11, allowing good vision to leeward of spinnaker 75. This allows the skipper to easily see approaching sailboats on the opposite tack or even on a different leg of a race, and take any evasive action needed.

While track 48 and car 55 comprise a preferred bowsprit positioning element, other structures providing similar functionality are possible. For example, a tackle or block arrangement may comprise the bowsprit positioning element. Such a structure may have a block mounted at each of the forward and aft positions of the bowsprit positioning element to secure bowsprit aft end 28*b* at either of these positions. Such a structure is not now considered preferred, but further experience may reveal advantages not now apparent.

Because attachment fitting 15 is much further from pivot 53, than is sleeve 33, the force that spinnaker 75 imposes on sleeve 33 and pivot 53 is considerable. Car 55 in particular may not be able to resist a large lateral force amplified by the lever arm of bowsprit 28.

Figure 3:
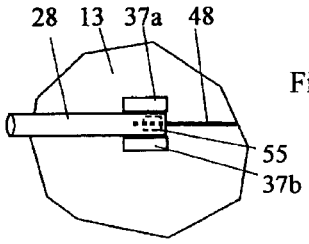
FIG. 3 is top section view of a sailboat showing preferred bracing for a bowsprit.

FIG. 3 shows internal bracing structure that provides added support for bowsprit aft end 28*b*. FIG. 3 is a downward section view of the area surrounding the forward position of car 55 as shown in FIG. 2. A short section of bowsprit 28 is shown projecting from car 55, shown in outline. Car 55 is shown mounted on track 48.

Similar braces 37*a* and 37*b* internal to hull 10 are shown on the starboard and port sides of the aft end 28*a* of bowsprit 28. Referring to FIGS. 1 and 2, one can see a side view of brace 37*a* extending vertically from the bottom 13 to the deck 11. Braces 37*a* and 37*b* are spaced apart only enough to allow bowsprit 28 to lie close to each and between both when in the extended position. Braces 37*a* and 37*b* stiffen and strengthen deck 11 and at the same time provide transverse support for aft end 28*a*.

Spinnaker 75 may on occasion impose a large transverse force component on bowsprit 28. Looseness in the coupling of bowsprit 28 to car 55 allows bowsprit 28 to contact brace 37*b* so that brace 37*b* bears most of the transverse load applied by bowsprit aft end 28*b* when spinnaker 75 is on the starboard side of hull 10 (port tack), as shown in FIGS. 1 and 2. When the sailboat is on starboard tack, spinnaker 75 is carried on the port side of hull 10, and brace 37*a* is contacted by and resists transverse load carried by aft end 28*b*.

Alternative bowsprit 28 support element designs may be desirable in some circumstances. For example, extending and retracting bowsprit while spinnaker 75 is filled may sometimes be necessary. This added functionality may require reduced friction between bowsprit 28 and the bowsprit 28 support element. I find that in these circumstances, the major load on fitting 15 is vertical, indicated by wear on the top of a test bowsprit 28.

Figure 4:
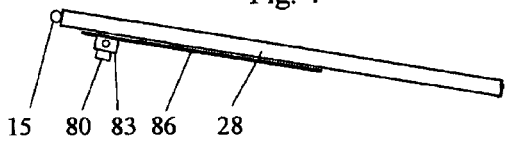
FIG. 4 is an open side view of a sailboat with a track and car comprising a bowsprit support element.

One possible alternative to address this concern is to construct the support element from one or more traveler tracks 86 as shown in FIG. 4, along with a car 83 sliding on track 86, instead of sleeve 33 and pivot 34. Such a track 86 is attached to the forward end of pole 28 and extends lengthwise in the aft direction. Car 83 is rotatably attached to a bracket 80 that is fixed to the interior of hull 10 near the bow. Bracket 80 will most likely be attached to deck 11. As bowsprit 28 is extended, car 83 slides along track 86 and rotates with respect to hull 10. Car 83 can in this way transmit forces from pole 28 to hull 10.

Figure 5:
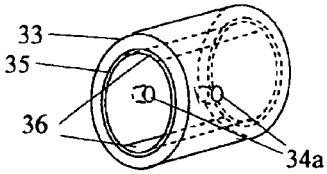
FIG. 5 is a perspective view of the sleeve for a bowsprit support element.

FIG. 5 shows details of sleeve 33 that provide another possible alternative for reducing friction between sleeve 33 and bowsprit 28. In the present preferred embodiment, sleeve 33 is formed of an aluminum cylinder having a bore with a Nylon liner 35 through which bowsprit 28 slides. A pivot hole 34*a* is present on each side of sleeve 33. Hole 34*a* may be threaded, and when so threaded, a suitable cap screw can be inserted through vertical walls of deck 11 below cowling 31 and screwed into each hole 34*a* to form pivot 34. Of course the cap screws must not extend past the liner 35 into the bore.

To reduce friction and wear between sleeve 33 and bowsprit 28, a strip of low-friction tape 36 is bonded to the bore surface of Nylon liner 35 at the top and bottom (12 o'clock and 6 o'clock) positions. Such a tape 36 may reduce wear on both liner 35 and bowsprit 28. A preferred type of tape 36 is known generically as "ultrahigh molecular weight polyethylene" tape. Experience shows that the major wear on bowsprit 28 and sleeve 33 occurs at the tops and bottoms of sleeve 33 and bowsprit 28. Tape 36 may reduce such wear.

A suitable tape 36 is available from Mcmaster-Carr Supply Co., 600 North County Line Road, Elmhurst, Ill. 60126 in a 2 in. wide, 0.0115 in. thick adhesive-backed, pull-off protective backing format, and designated by Mcmaster-Carr as UHMW polyethylene tape. Other suitable low-friction tapes are likely available as well.

Figure 6:
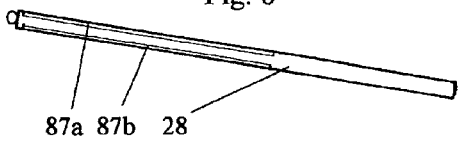
FIG. 6 is a side view of the bowsprit with low-friction tape attached to the top and bottom of the bowsprit surface that slides through a sleeve.
Figure 7:
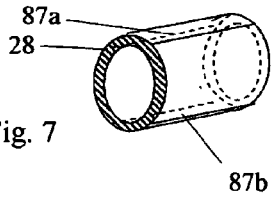
FIG. 7 is a section of the bowsprit of FIG. 6 showing the low-friction tape more clearly.

FIGS. 6 and 7 show the presently preferred structure for reducing friction and wear on bowsprit 28. A strip 87*a* of low-friction tape is bonded to the top surface of bowsprit 28 as is shown in both FIGS. 6 and 7. A second low-friction tape strip 87*b* may be bonded to the bottom surface of bowsprit 28. These tape strips 87*a* and 87*b* also can be the 2 in. wide UHMW polyethylene tape preferred for the surface of the bore in sleeve 33.

While on a beat, bowsprit 28 will typically be held in the retracted position shown in FIG. 1 with line segment 57*c* cleated in cleat 62 to keep car 55 and bowsprit 28 from sliding forward. Since the downward slope of bowsprit 28 tends to keep bowsprit 28 in the retracted position, cleating line segment 57*c* may not be necessary but assures that bowsprit 28 will not inadvertently extend.

When nearing the end of a beat, the crew starts the process of setting the spinnaker 75 by uncleating the tack line 57, pulling fitting 15 toward the cockpit, and attaching the tack of spinnaker 75 to the fitting 15. Then the crew extends bowsprit 28 by running tack line 57 and trimming (pulling) on line segment 41*c*. At the same time, the tack line 57 is held to maintain the position of fitting 15 snugly against bowsprit end 28*a* Once bowsprit 28 is fully extended, tack line segment 57*c* is cleated in cleat 62.

As the sailboat bears off to a reach, the spinnaker halyard is pulled to lift spinnaker 75. Once the spinnaker 75 is lifted, the sheet attached to the clew of spinnaker 75 is adjusted to provide optimal trim for spinnaker 75.

Jibing of spinnaker 75 occurs in the normal way, by jibing boom 74 and more or less simultaneously allowing spinnaker 75 to blow through the space between the spinnaker luff 78 and forestay 63.

Spinnaker 75 is dropped by releasing the spinnaker halyard and at the same time pulling the tack line segment 57*c* until bowsprit 28 is fully retracted. Line segment 57*c* is then released to allow spinnaker 75 to be detached from fitting 15 by crew within the cockpit. Line segment 57*c* can then be re-cleated in cleat 62 to prevent bowsprit 28 from extending accidentally.

For an A scow, I find the following approximate parameters for this bowsprit system are suitable:

| | |
|---|---|
| Bowsprit length | 11 ft. |
| Extended length | 6 ft. |
| Articulation angle | 25–30° |
| Fitting 15 distance above waterline when bowsprit extended | 4–5 ft. |
| Sleeve 33 length | 3 in. |
| Sleeve 33 inside dia. | 4 in. |
| Sleeve 33 outside dia. | 5 in. |
| Nylon lining 35 thickness | 0.12 in. |

I find this bowsprit 28 extending system improves safety while steering sailboats with asymmetrical spinnakers.

The preceding has described my invention. What I wish to protect by letters patent is as follows:

What is claimed is:

1. A bowsprit extending system for a bow of a sailboat hull having a deck above a waterline of the hull, said system placing an elongate bowsprit having a forward end and an aft end in either a retracted position with the bowsprit forward end near the forward end of the sailboat, or in an extended position with the bowsprit forward end forward of and substantially further above the waterline than is the sailboat deck, said system comprising:

a) a bowsprit positioner having a forward position and an aft position and mounted generally fore and aft on the sailboat bottom at the bow, said bowsprit's aft end positionable at either of the forward and aft positions of the positioner; and b) a bowsprit support element mounted on the hull vertically above and forward of the positioner forward position, and in supportive connection to the bowsprit between the ends, said bowsprit having the retracted position when the bowsprit aft end is positioned at the positioner aft position and the extended position when positioned at the positioner forward position, thereby placing the bowsprit when in the extended position with the forward end thereof substantially farther above the waterline than is the deck.

2. The bowsprit extending system of claim 1 wherein the bowsprit positioner comprises:

a) an extender track mounted between the positioner's forward and aft locations to the sailboat bottom;

b) an extender car mounted on the extender track and shiftable fore and aft along the extender track between the positioner's forward and aft positions;

c) a bowsprit connector attaching the extender car to the bowsprit's aft end; and d) a bowsprit position control mechanism in operative attachment to the extender car, and including a control element for controlling the fore and aft position of the extender car.

3. The bowsprit extending system of claim 2, wherein the bow includes a deck and wherein the extender track is mounted below the deck and the bowsprit projects through the deck when in the extended position.

4. The bowsprit extending system of claim 3, wherein the bowsprit support element is mounted in the bow.

5. The bowsprit extending system of claim 4, wherein the bowsprit support element comprises a slider.

6. The bowsprit extending system of claim 5, wherein the slider comprises a sleeve mounted at the bow forward and above the extender track and at least partly surrounding the bowsprit, said sleeve having a bore through which the bowsprit slides as the car shifts fore and aft along the extender track.

7. The bowsprit extending system of claim 6 wherein the sleeve is mounted on a pivot in the deck and whose axis is generally parallel to the waterline of the unheeled hull and transverse with respect to the hull centerline.

8. The bowsprit system of claim 7, wherein the sleeve includes a low-friction tape attached to the surface of a bore thereof, and against which the bowsprit slips.

9. The bowsprit system of claim 8, wherein the low-friction tape comprises ultrahigh molecular weight polyethylene tape.

10. The bowsprit system of claim 8, including a vertically extending bracing structure attached to the hull adjacent to the positioner's forward position to bear transverse load applied by the bowsprit aft end.

11. The bowsprit system of claim 6, wherein the bowsprit includes a low friction tape attached to at least a portion of the upper surface of the bowsprit passing through the sleeve.

12. The bowsprit system of claim 11, wherein the low friction tape comprises ultrahigh molecular weight polyethylene tape.

13. The bowsprit system of claim 5, wherein the slider system comprises a bowsprit track mounted along the bowsprit from the forward end and extending aft therefrom, and a bowsprit car slidably mounted on the bowsprit track, and attached to hull near the bow.

14. The bowsprit system of claim 13, wherein the bowsprit car is rotatably mounted to the deck.

15. The bowsprit system of claim 3, wherein the bowsprit connector comprises a pivot pin.

16. A support system for an elongate bowsprit for a bow of a sailboat hull, said bowsprit having a forward end and an aft end, said system supporting the bowsprit in either a retracted position with the bowsprit forward end near the forward end of the sailboat, or in an extended position with the bowsprit forward end forward of and substantially further above the waterline than is the sailboat hull, said support system contained exclusively within the sailboat hull and supporting the bowsprit when extended, at a predetermined articulation angle about a substantially horizontal axis relative to the sailboat hull, said articulation angle at least 20° greater than the angle of the bowsprit in the retracted position.

17. The support system of claim 16, wherein the articulation angle about the horizontal axis is at least 25 ° greater than the angle of the bowsprit in the retracted position.

18. The support system of claim 17, wherein the articulation angle about the horizontal axis is at least 30 ° greater than the angle of the bowsprit in the retracted position.

19. The support system of claim 16, further comprising a sleeve attached to the sailboat at the bow thereof through which the bowsprit can slide.

20. The support system of claim 19, including on the bowsprit surface, a strip of low friction tape that slides through the sleeve as the bowsprit slides through the sleeve.

* * * * *